US005617649A

United States Patent [19]

Joo

[11] Patent Number: 5,617,649

[45] Date of Patent: Apr. 8, 1997

[54] DEVICE AND METHOD FOR DRYING FLUORESCENT MATERIAL

[75] Inventor: Won-geun Joo, Suwon, Rep. of Korea

[73] Assignee: Samsung Display Devices Co., Ltd., Kyungki-do, Rep. of Korea

[21] Appl. No.: 647,455

[22] Filed: May 7, 1996

[30] Foreign Application Priority Data

May 15, 1995 [KR] Rep. of Korea ..... 95-12000

[51] Int. Cl.[6] ..... F26B 5/08

[52] U.S. Cl. ..... 34/315; 34/424; 34/425; 34/499; 34/63; 34/132; 34/605; 34/187

[58] Field of Search ..... 34/315, 381, 424, 34/425, 469, 499, 535, 61, 63, 58, 132, 595, 605, 187

[56] References Cited

U.S. PATENT DOCUMENTS

| | | | |
|---|---|---|---|
| 763,388 | 6/1904 | Gatham | 34/469 |
| 2,130,154 | 9/1938 | Riley | 34/315 X |
| 2,643,956 | 6/1953 | Kuebler et al. | 34/132 X |
| 2,837,831 | 6/1958 | Gates | 34/499 X |
| 3,615,663 | 10/1971 | Becker | 99/57 |
| 4,305,211 | 12/1981 | Petereson | 34/605 X |
| 4,350,663 | 9/1982 | McAlister | 422/137 |
| 4,356,934 | 11/1982 | Knake | 221/96 |
| 4,506,453 | 3/1985 | Shirley, Jr. et al. | 34/132 X |
| 4,854,941 | 8/1989 | Chedgy | 34/595 X |

*Primary Examiner*—John M. Sollecito
*Assistant Examiner*—Steve Gravini
*Attorney, Agent, or Firm*—Leydig, Voit & Mayer

[57] ABSTRACT

A device and method for drying a fluorescent material are provided. The device includes a container having a predetermined space for containing a fluorescent material, a first driver for rotating the container, a heater for heating the container, a vacuum unit for creating a partial vacuum in the container to discharge moist air from the container, a supplier for supplying dry air to the container, an exhausting unit for exhausting the fluorescent material dried in the container, and a controller for controlling the respective device and the first dryer. The drying method includes the steps of placing a cleaned fluorescent material into a dryer, heating the dryer while rotating the dryer, injecting dry air into the dryer and exhausting moist air from the dryer, and vacuum-transferring the fluorescent material from the dryer to a predetermined storage tank. With the device and method, drying a wet fluorescent material without hardening it obviates the need for a grinding process and reduces a drying time and manual processes. Thus, a fluorescent material drying process can be performed by few personnel in a clean working place.

6 Claims, 5 Drawing Sheets

DEVICE AND METHOD FOR DRYING FLUORESCENT MATERIAL

BACKGROUND OF THE INVENTION

The present invention relates to a device and a method for drying a fluorescent material for use in a cathode ray tube (CRT).

As is well known, the inner surface of a CRT panel is coated with a film of a fluorescent material. The fluorescent film radiates light in response to thermal electrons emitted from an electronic gun. The fluorescent material is cleaned and dried for use in the fluorescent film.

FIG. 1 is a flow-chart of a conventional process for cleaning and drying a fluorescent material and FIG. 2 is a schematic perspective view of a dryer for use in the process. As shown, a fluorescent material 122 is cleaned with water, in step 110. In step 111, the fluorescent material is preliminarily dried. In step 112, the wet fluorescent material is placed on a drying tray 121. In step 113, the drying tray 121 is placed in or mounted within a hot-air dryer 120 for drying the fluorescent material. The fluorescent material hardens while being dried in the hot-air dryer 120. Lumps of the hard fluorescent material are ground in a grinder (not shown) in step 114. In step 115, the ground fluorescent material is re-mounted and dried completely in the hot-air dryer 120. In step 116, the dried fluorescent material is sifted in a sifter (not shown).

However, the known process requires excessive time (about 30 hours) to dry one batch of the wet fluorescent material 122 with the hot-air dryer 120. That is, since the steps of mounting the wet fluorescent material 122 into the hot-air dryer 120, grinding the hard fluorescent material, re-mounting the ground fluorescent material in the hot-air dryer, and transferring the dried fluorescent material to the sifter are all manually performed, time consumption is large and the work is somewhat difficult. Moreover, manually grinding the hard fluorescent material produces dust.

SUMMARY OF THE INVENTION

The object of the present invention is to provide a device and a method for drying a fluorescent material which are capable of reducing drying time and contributing to a clean and automated working environment.

To achieve the above object, there is provided a fluorescent material drying method comprising the steps of: placing a cleaned fluorescent material into a dryer; heating the dryer while rotating the dryer; injecting dry air into the dryer and exhausting moist air from the dryer; and vacuum-transferring the fluorescent material from the dryer to a predetermined storage tank.

To achieve another aspect of the above object, there is also provided a fluorescent material drying device comprising: a container having a predetermined space for containing a fluorescent material; a first driver for rotating the container; means for heating the container; means for creating a partial vacuum in the container to discharge moist air from the container; means for supplying dry air to the container; means for exhausting the fluorescent material dried in the container; and means for controlling the respective means and the first dryer.

The exhausting means comprises a tank connected to the container and the vacuum means, for containing the dried fluorescent material exhausted from the container, and means installed below the tank for transferring the fluorescent material.

The vacuum means comprises a vacuum tank connected to the container, a vacuum pump for pumping air from the vacuum tank, and a condenser installed between the container and the vacuum tank, for condensing the moist air introduced from the container into the vacuum tank.

The heating means comprises a jacket surrounding a portion of the container, and a steam supply/exhaust unit for supplying steam to the jacket and exhausting steam from the jacket.

The device and method for drying the fluorescent material according to the present invention possess the advantages of: (1) drying the wet fluorescent material without the material hardening obviates the need for a grinding process; (2) the automated process reduces the number of personnel required to perform the task; (3) a working environment can remain clean; and (4) the forcible injection of dry air reduces drying time.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
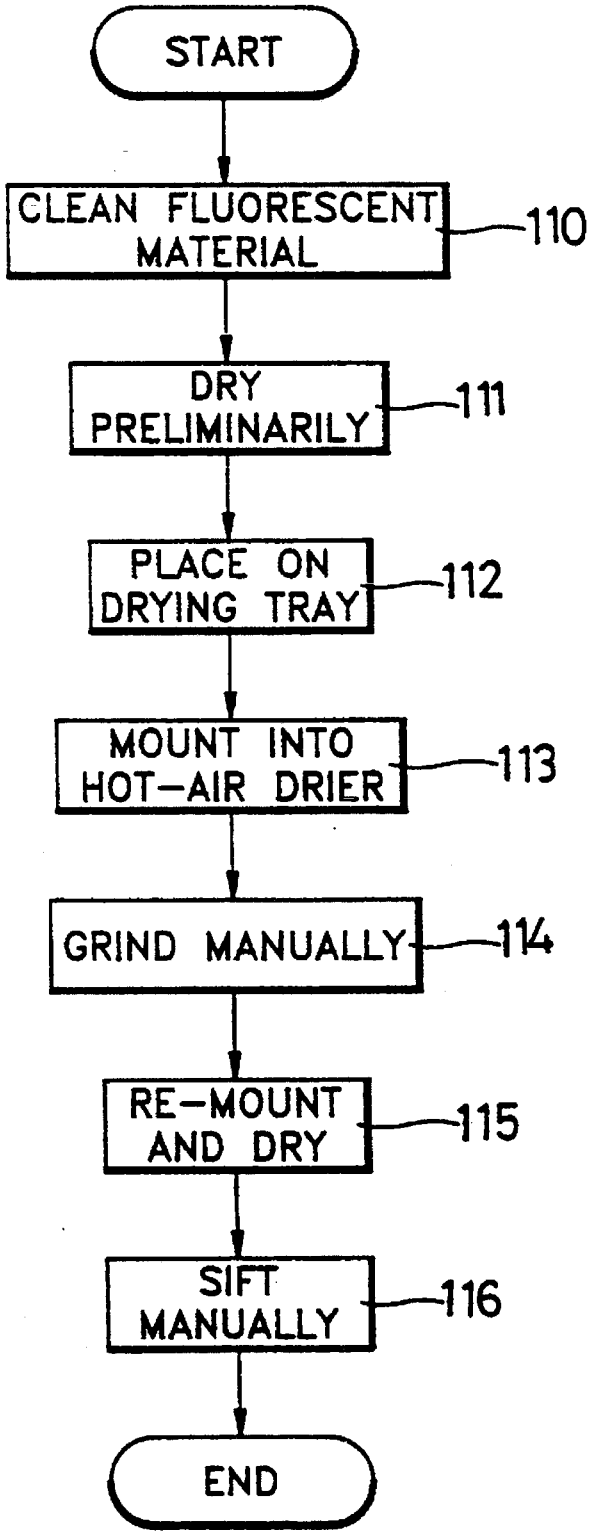
FIG. 1 (PRIOR ART)
FIG. 1 is a flow-chart of a conventional method for cleaning and drying a fluorescent material.
Figure 2:
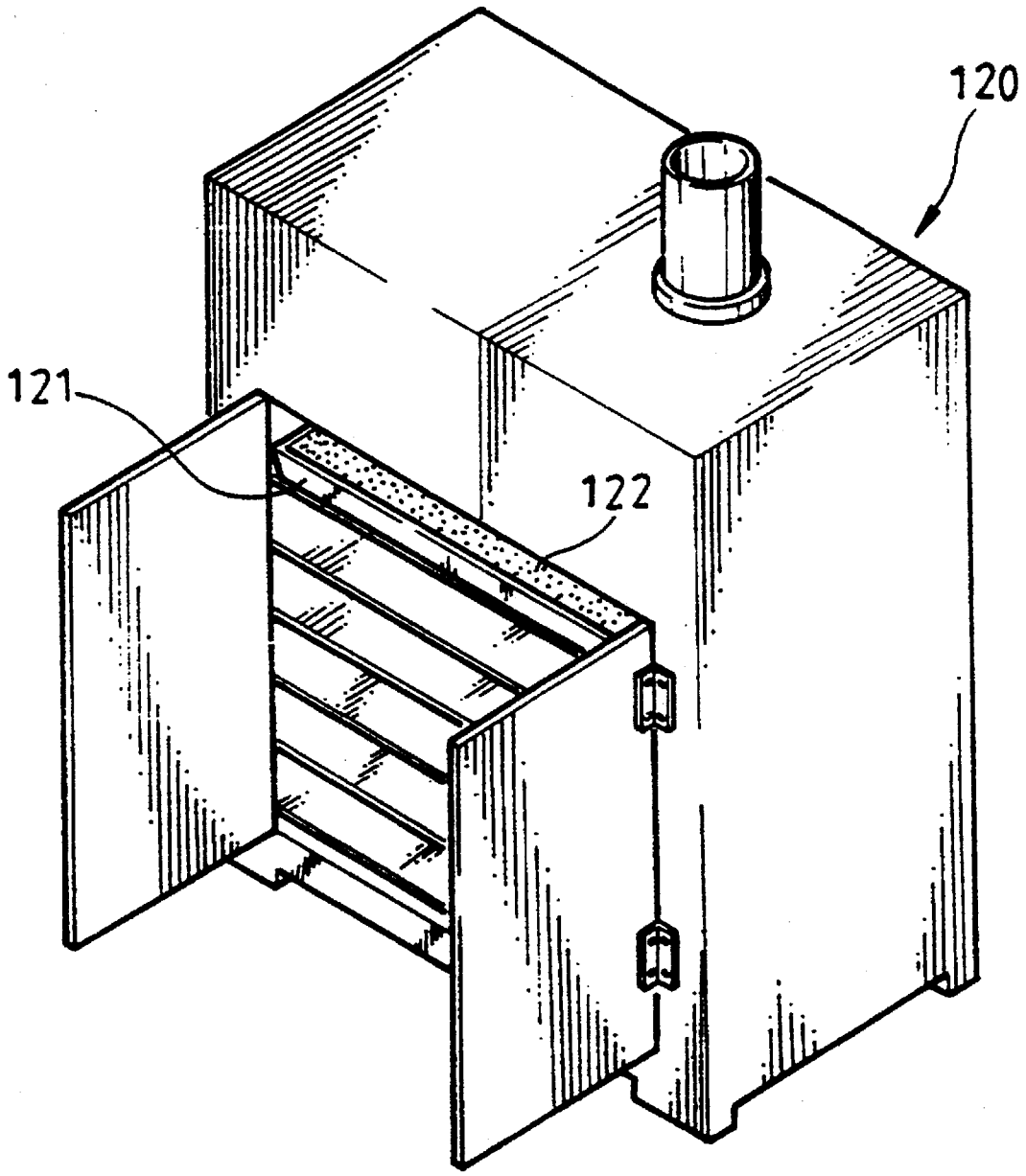
FIG. 2 (PRIOR ART)
FIG. 2 is a perspective view of a conventional hot-air dryer for use in the conventional drying process.
Figure 3:
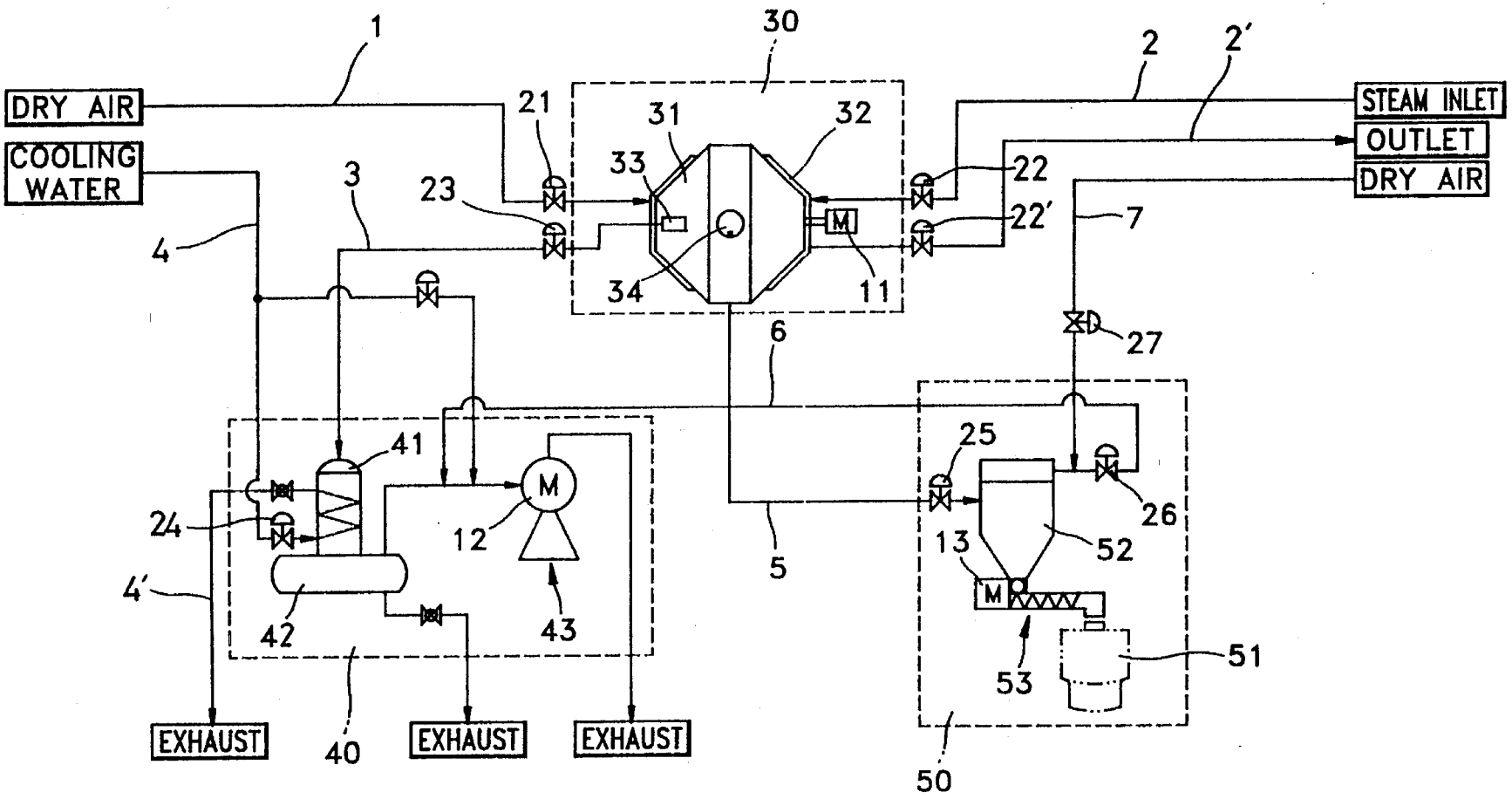
FIG. 3 is a schematic view of a fluorescent material drying system according to the present invention.

As shown in FIG. 3, a fluorescent material drying device according to the present invention is comprised of a vacuum drying unit 30, a vacuum unit 40, an exhaust tank unit 50, and a controller (not shown). The vacuum drying unit 30 is shown in FIG. 5 in detail.

Figure 5:
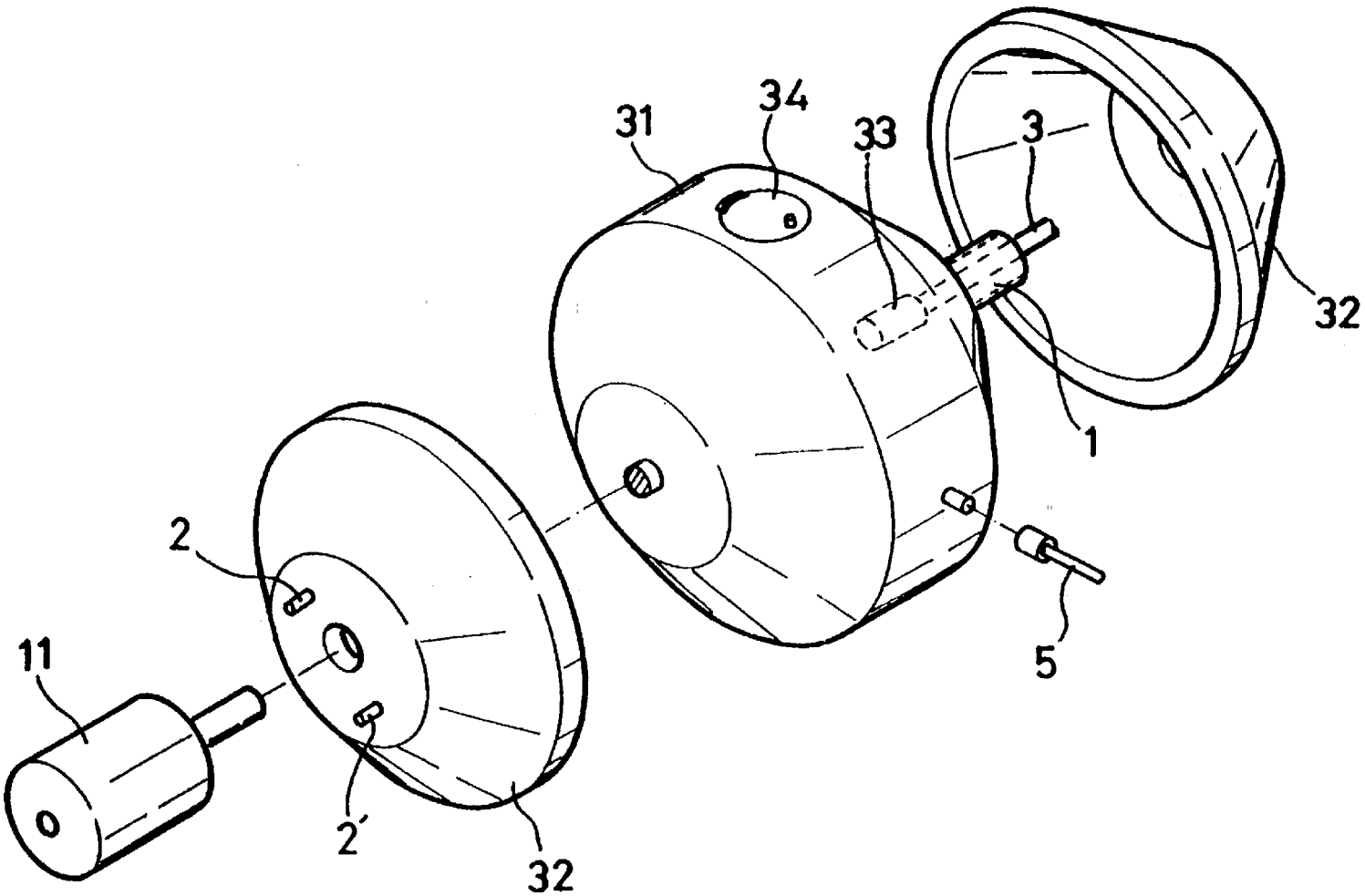
FIG. 5 is an exploded perspective view of a vacuum drying unit in the fluorescent material drying device of the present invention.

Referring to FIGS. 3 and 5, the vacuum drying unit 30 has a vacuum dryer 31 for vacuum-drying a fluorescent material, a first motor 11 for rotating the vacuum dryer 31, and a jacket 32 for heating the vacuum dryer 31 with steam.

The vacuum dryer 31 is rotated by the first motor 11, to prevent wet fluorescent material from hardening while being dried. The vacuum dryer 31 is provided with a door 34 for receiving the fluorescent material and is coupled to a first pipe 1 for introducing ambient dry air into the dryer. A first valve 21 for controlling the flow of air into the vacuum dryer 31 is mounted on the first pipe 1.

Second pipes 2 and 2' for supplying and exhausting steam, respectively, are coupled to the jacket 32. Second valves 22 and 22' are respectively installed at the second pipes 2 and 2', for controlling the flow of steam supplied to or exhausted from the jacket 32.

Referring to FIG. 3, the vacuum unit 40 has a vacuum tank 42 having a condenser 41 installed thereon, a vacuum pump 43 for pumping air from the vacuum tank 42, and a second motor 12 for driving the vacuum pump 43.

The condenser 41 of the vacuum unit 40 is connected to the vacuum dryer 31 of the vacuum drying unit 30 by a third pipe 3, so that moist air is sucked from the vacuum dryer 31 through the condenser 41 to the vacuum tank 42. A filter 33 (see also FIG. 5) is installed at the end portion of the third pipe 3, which is connected to the vacuum dryer 31, to prevent the fluorescent material from being introduced into the vacuum tank 42, while being dried in the vacuum dryer 31. A third valve 23 is installed at the third pipe 3, for controlling the flow of air from the vacuum dryer 31 into the vacuum tank 42.

The condenser 41 functions to condense the moist air introduced from the vacuum dryer 31. Fourth pipes 4 and 4' are respectively connected to upper and lower parts of the condenser 41 to provide cooling water and exhaust cooling water. A fourth valve 24 is installed at the fourth pipe 4, for controlling the flow of the cooling water into the condenser 41.

Referring to FIG. 3, the exhaust tank unit 50 has an exhaust tank 52 for containing the fluorescent material which has been dried in the vacuum dryer 31, a sifter 51 for sifting the fluorescent material from the exhaust tank 52, a screw feeder 53 for transferring the fluorescent material to the sifter 51, and a third motor 13 for rotating the screw feeder 53.

The exhaust tank 52 is connected to the vacuum dryer 31 by a fifth pipe 5. As shown in FIGS. 3 and 5, while the fluorescent material is transferred from the vacuum dryer 31 to the exhaust tank 52, the fifth pipe 5 is coupled to the vacuum dryer 31. On the contrary, while the vacuum dryer 31 is rotated by the first motor 11, the fifth pipe 5 is detached from the vacuum dryer 31. A fifth valve 25 is installed at the fifth pipe 5, for controlling the flow of the dried fluorescent material into the exhaust tank 52.

A sixth pipe 6 connects the exhaust tank 52 to the vacuum pump 43. A sixth valve 26 is installed at the sixth pipe 6, for controlling the flow of air to the vacuum pump 43. A seventh pipe 7 is coupled to the sixth pipe 6, for supplying dry air to the sixth pipe 6. A seventh valve 27 is installed at the seventh pipe 7, for controlling the flow of the dry air.

The valves 21, 22, 22', 23, 24, 25, 26 and 27, and the motors 11, 12 and 13 are connected to the controller (not shown) for controlling their operations.

Figure 4:
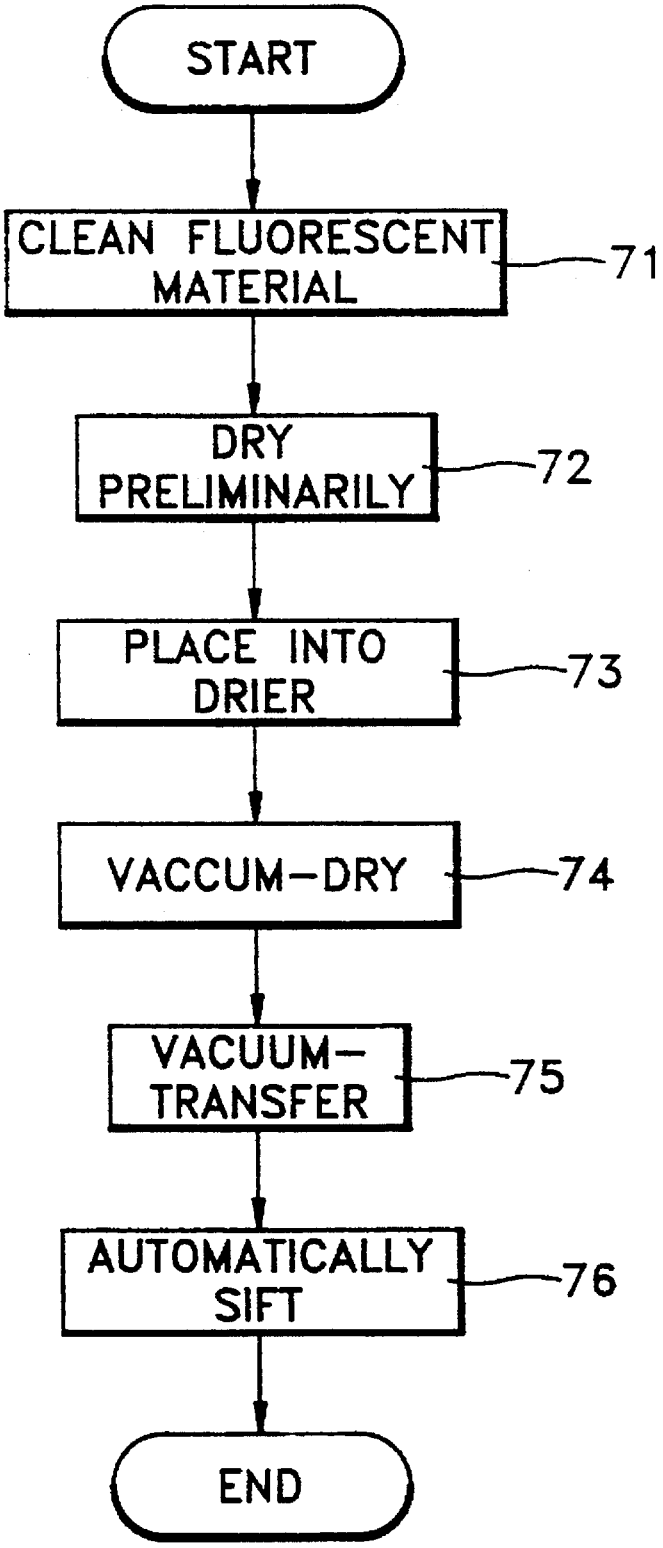
FIG. 4 is a flow-chart of a fluorescent material drying method of the present invention.

FIG. 4 is a flow-chart of a method for drying a fluorescent material according to the present invention.

Referring to FIGS. 3 through 5, a fluorescent material is cleaned with water in step 71 and preliminarily dried in step 72. The wet fluorescent material is placed into the vacuum dryer 31, in step 73.

Thus, when step 73 is completed, the fluorescent material starts to be dried in vacuum, in step 74. During the step, the first and second motors 11 and 12 are rotated and the first through fourth valves 21–24 are opened. Subsequently, the vacuum dryer 31 is rotated, the vacuum pump operates and the vacuum dryer 31 is heated by operation of the jacket 32. At the same time, dry air is introduced into the vacuum dryer 31 by means of the first pipe 1 and the moist air thereof is exhausted from the vacuum dryer 31 into the vacuum tank 42 by means of the third pipe 3.

When the fluorescent material is completely dried in step 74, step 75 is performed. In step 75, the fifth pipe 5 is connected to the vacuum dryer 31. Here, the first motor 11 stops operating, the second and third valves 22, 22' and 23 are closed, and the fourth valve 24 is also closed. Thus, the vacuum dryer 31 stops rotating, the jacket 32 no longer performs heating, and the vacuum dryer 31 returns to atmospheric pressure. Under this condition, when the fifth and sixth valves 25 and 26 are opened, the dried fluorescent material is transferred from the vacuum dryer 31 through the fifth pipe 5 to the exhaust tank 52. Here, the seventh valve 27 is moderately opened, thus facilitating the vacuum-transfer.

Then, the fluorescent material transferred to the exhaust tank 52 in step 75 is automatically sifted in step 76. In this step, when the third motor 13 operates, the fluorescent material is transferred to and sifted in the sifter 51.

As described above, the device and method for drying the fluorescent material according to the following present invention exhibit the advantages: (1) drying the wet fluorescent material without the material hardening obviates the need for a grinding process; (2) the automated processes reduces the number of personnel required; (3) the working environment stays clean; and (4) the forcible injection of dry air for drying the fluorescent material leads to a 33% decrease in drying time, in comparison with that of the conventional fluorescent material drying process.

What is claimed is:

1. A fluorescent material drying method comprising:

placing a fluorescent material cleaned with water into a dryer;

heating said dryer while rotating said dryer;

injecting dry air into said dryer and exhausting moist air from said dryer; and vacuuming and transferring said fluorescent material from said dryer to a storage tank.

2. A fluorescent material drying device comprising:

a container for containing a fluorescent material;

a first dryer for rotating said container:

means for heating said container;

means for evacuating said container to discharge moist air from said container;

means for supplying dry air to said container; and means for vacuuming and transferring dried fluorescent material from said container to a storage tank.

3. A fluorescent material drying device as claimed in claim 2 wherein said exhausting means comprises a tank connected to said container and said evacuating means, for containing the dried fluorescent material exhausted from said container, and means installed adjacent to said tank for transferring said fluorescent material.

4. The fluorescent material drying device as claimed in claim 3 comprising a sifter for sifting the dried fluorescent material transferred by said means for vacuuming and transferring.

5. The fluorescent material drying device as claimed in claim 2 wherein said means for evacuating comprises a vacuum tank connected to said container, a vacuum pump for pumping air from said vacuum tank, and a condenser installed between said container and said vacuum tank, for condensing the moist air introduced from said container into said vacuum tank.

6. The fluorescent material drying device as claimed in claim 2 wherein said heating means comprises a jacket surrounding a portion of said container, and a steam supply and exhaust unit for supplying steam to said jacket and exhausting steam from said jacket.

* * * * *